United States Patent [19]

Halter et al.

[11] 4,051,590

[45] Oct. 4, 1977

[54] METHOD FOR HOT FORGING FINISHED ARTICLES FROM POWDER METAL PREFORMS

[75] Inventors: Richard F. Halter; Richard L. DeWeese, both of Cincinnati, Ohio

[73] Assignee: Cincinnati Incorporated, Cincinnati, Ohio

[21] Appl. No.: 468,002

[22] Filed: May 8, 1974

Related U.S. Application Data

[63] Continuation of Ser. No. 298,832, Oct. 19, 1972, abandoned, which is a continuation-in-part of Ser. No. 91,419, Nov. 20, 1970, abandoned.

[51] Int. Cl.[2] ..... B22F 3/24

[52] U.S. Cl. ..... 29/420.5; 29/DIG. 31; 72/38; 72/364

[58] Field of Search ..... 29/420.5, 420, DIG. 31; 72/13, 38, 342, 364; 75/224, 225, 226; 219/7.5, 149, 150, 153, 154

[56] References Cited

U.S. PATENT DOCUMENTS

| | | | |
|---|---|---|---|
| 2,449,365 | 9/1948 | Bober et al. | 219/154 |
| 3,645,728 | 2/1972 | Hrinevich | 29/420.5 |
| 3,779,747 | 12/1973 | Conta | 29/420.5 |

*Primary Examiner*—E. M. Combs

*Attorney, Agent, or Firm*—Melville, Strasser, Foster & Hoffman

[57] ABSTRACT

A production, automated method of hot forging finished articles from powder metal preforms, and an apparatus for carrying out the method, wherein the preforms are passed through an induction heating device, whereby they are heated to at least forging temperature. Thereafter, the heated preforms are passed to a pair of dies whereby they are forged into finished articles, after which they are cooled. The entire process may, if required, be conducted in a non-oxidizing atmosphere. The apparatus includes an induction heating means, a forging means, a cooling station, feeding or conveying means to introduce the preforms into the induction heating means, and conveying means to move the preforms from the heating means to the forging means and from the forging means to the cooling station. The entire operation is automatic, including the feeding of the preforms through the apparatus, the control of temperature, and the lubrication and preheating of the dies. Means may be provided to conduct the entire operation in a non-oxidizing atmosphere. Furthermore, the method and apparatus may include the step of and means for sintering the preform so that a production, fully automated system is provided from the compacting press to the finished product.

16 Claims, 9 Drawing Figures

INVENTOR/S

RICHARD F HALTER and

RICHARD L. DE WEESE

BY *Melville, Strasser, Foster and Hoffman*

ATTORNEYS

INVENTOR/S
RICHARD F. HALTER and
RICHARD L. DE WEESE
BY Melville, Strasser, Foster and Hoffman
ATTORNEYS

INVENTOR/S

RICHARD F HALTER and
RICHARD L. DE WEESE

BY *Melville, Strasser, Foster and Hoffman*
ATTORNEYS

INVENTOR/S
RICHARD F. HALTER and
RICHARD L. DE WEESE

BY Melville, Strasser, Foster and Hoffman
ATTORNEYS

INVENTOR/S

RICHARD F. HALTER and
RICHARD L. DE WEESE

BY Melville, Strasser, Foster and Hoffman
ATTORNEYS

INVENTOR/S

RICHARD F. HALTER and
RICHARD L. DE WEESE

BY Melville, Strasser, Foster and Hoffman
ATTORNEYS

METHOD FOR HOT FORGING FINISHED ARTICLES FROM POWDER METAL PREFORMS

CROSS REFERENCE TO RELATED APPLICATION

This is a continuation of copending application Ser. No. 298,832, filed Oct. 19, 1972 in the name of the same inventors and entitled METHOD AND APPARATUS FOR HOT FORGING FINISHED ARTICLES FROM POWDER METAL PREFORMS, now abandoned, which in turn is a continuation-in-part application of the co-pending application in the name of the same inventors, Ser. No. 91,419, filed Nov. 20, 1970 and entitled METHOD AND APPARATUS FOR HOT FORGING FINISHED ARTICLES FROM POWDER METAL PREFORMS, now abandoned.

BACKGROUND OF THE INVENTION

1. Field of the Invention

The present invention relates to a method and apparatus for hot forging powder metal preforms, and more particularly to a fully automated, production method and apparatus for carrying out the method.

2. Description of the Prior Art

The art of hot forging finished articles from powder metal preforms is a relatively new one. Heretofore, this art has involved the provision of a heating furnace and a forging means. The preforms were first heated in the furnace and then carried, in heated condition, to the forging means. This procedure involved a number of workers and was time consuming.

When it was necessary to preform the heating and hot forging steps in a protective atmosphere, such as a non-oxidizing atmosphere, it was the usual practice to insert the preform in a die set and place the entire preform-die set assembly in the furnace. Thereafter, this entire assembly was transferred to the press and the hot forging operation was performed. Under these circumstances, prior art workers relied upon the protective atmosphere, which had penetrated the die set, to protect the preform during the forging operation. Again, this operation was slow and required the use of many tool sets.

Where heating was performed by high frequency electrical energy, the high frequency heating apparatus was generally located in the vicinity of the dies so that the workpiece was heated in the impact forging position. Such a method was taught in U.S. Pat. No. 3,331,686. Under these circumstances it was necessary to heat and forge a workpiece before the heating of the next workpiece could begin.

As a consequence, the practice of hot forging finished articles from powder metal preforms has not lent itself to a high-rate, production process.

Prior art workers have devised systems whereby ordinary forging processes have been automated. Such a system, for example, is taught in British Pat. No. 884,709. However, ordinary forging of preformed blanks is fundamentally different from the hot forging of powder metal preforms into finished products. In the usual forging practice, as exemplified by the above mentioned British patent, the operation may start with preformed blanks. The blanks are characterized by the fact that they are fully dense, wrought or fusion parts. The blanks contain an excess of metal which is lost as flash or the like during the forging operation with the result that the trimmed forged piece weighs less than the initial blank. In ordinary forging operations, the pieces are subject only to surface oxidation which can be readily removed. Finally, the ordinary forging process does not produce a "finished part" within the meaning of that phrase as used herein and in the claims (i.e. a part involving no scale removal and having finished surfaces equivalent to precision machined surfaces). In the ordinary forging process the blanks are subjected to one or more forging steps (the above noted British patent teaches two) followed by machining or the like.

The hot forging of powder metal preforms, on the other hand, is wholly different. First of all, the powder metal preforms are porous structures, as opposed to the dense metal preforms for ordinary forging. While the hot forging of powder metal preforms may and generally does involve a change in shape, it is primarily a densification or consolidation step. There is no flash and no loss of material, the forged part weighing the same as the powder metal preform. This is extremely significant because it means that oxidation cannot be tolerated.

Unlike ordinary forging preforms, powder metal preforms are subject to both internal and external oxidation. Internal oxidation (the metal being porous) must be avoided because such oxidation would be trapped within the metal preform, seriously affecting its properties. External oxidation is similarly to be avoided. Since all of the metal of the powder metal preform is used to form the final product, none can be lost to external oxidation.

Finally, unlike ordinary forging processes, the hot forging of powder metal preforms produces in one forging blow a finished product having surfaces equivalent to precision machined surfaces.

The present invention is directed to a method and apparatus whereby the hot forging of finished articles from powder metal preforms may be accomplished inexpensively, at a high production rate and fully automatically. The hot forging method of the present invention may be practiced by a single operator. The process and apparatus results in a considerable economic savings in materials and the number of steps required to produce the final product. The process may include a sintering step so as to comprise a fully automated, production process from the compacting press to the final product. The final product, itself, demonstrates properties and characteristics equivalent to or superior to products produced by ordinary forging processes.

BRIEF SUMMARY OF THE INVENTION

The invention has for its principal object the production of finished forged work pieces such, for example, as small differential pinion gears and the like, from powder metal preforms. The preforms may be in the sintered form or in the green form, as desired. The compacting of preforms from powder metal is well understood and does not form a part of the present invention.

in one embodiment of the present invention, the powder metal preforms of suitable metallurgical composition are introduced into a sealed space, the air is purged from the sealed space and a non-oxidizing atmosphere is introduced into the sealed space. The preforms are fed from the above mentioned sealed space into a sealed system subjected to a non-oxidizing atmosphere and the preforms are fed along a path and through an induction heating unit whereby they are heated up to forging temperature. Within the sealed system an apparatus is provided to move the heated preforms into position for forging and to move them from the forging position to a discharge and cooling station. The cooling station also is subjected to a non-oxidizing atmosphere and means are provided whereby periodically the cooling chamber may be sealed off from the rest of the system and opened for removal of finished and cooled work pieces therefrom, whereupon it may be resealed and purged and connected into the sealed system. Means are provided in connection with the forging dies to heat them to a relatively low temperature to prevent heat checking and means are provided to cool the dies after a forging stroke and to lubricate them for a subsequent stroke.

As will be discussed hereinafter, under some circumstances it is not necessary to maintain the preforms in a non-oxidizing atmosphere during the heating, forging and cooling steps. Therefore, a second embodiment of the present invention is the same as that just described, with the exception that means are not provided to maintain the preforms in a non-oxidizing atmosphere. Under these circumstances, any suitable means may be used to introduce the preforms into the induction heating unit. Similarly, the final cooling station may take any desired form.

In a third embodiment of the present invention, similar to those described above, a cooling unit is located in association with the induction heating unit. Under these circumstances, the preform may be heated to a predetermined temperature above the forging temperature and then cooled to the optimum forging temperature prior to the forging step. Thus, a controlled temperature distribution throughout the body of each preform may be maintained and a final product may be produced having desired metallurgical properties produced by the heating and cooling steps.

In a fourth embodiment of the invention, which again is applicable both to a situation wherein a non-oxidizing atmosphere is maintained about the preforms during the process steps and to a situation wherein a non-oxidizing atmosphere is not needed, the preforms are deposited from the induction heating unit onto a tray-like device. Means are provided to advance the preforms along the tray-like device to a position wherein they are engaged by the above mentioned apparatus for moving them into position for forging and thence to the discharge and cooling station. Again, in this embodiment, the preforms may be heated to a predetermined temperature above forging temperature and allowed to cool to an optimum forging temperature during their travel along the tray-like device.

In a final embodiment a sintering step for the preforms and means therefor are incorporated in the system whereby to provide a fully automated, production system from the compacting press to the final product.

DETAILED DESCRIPTION OF THE INVENTION

Figure 1:
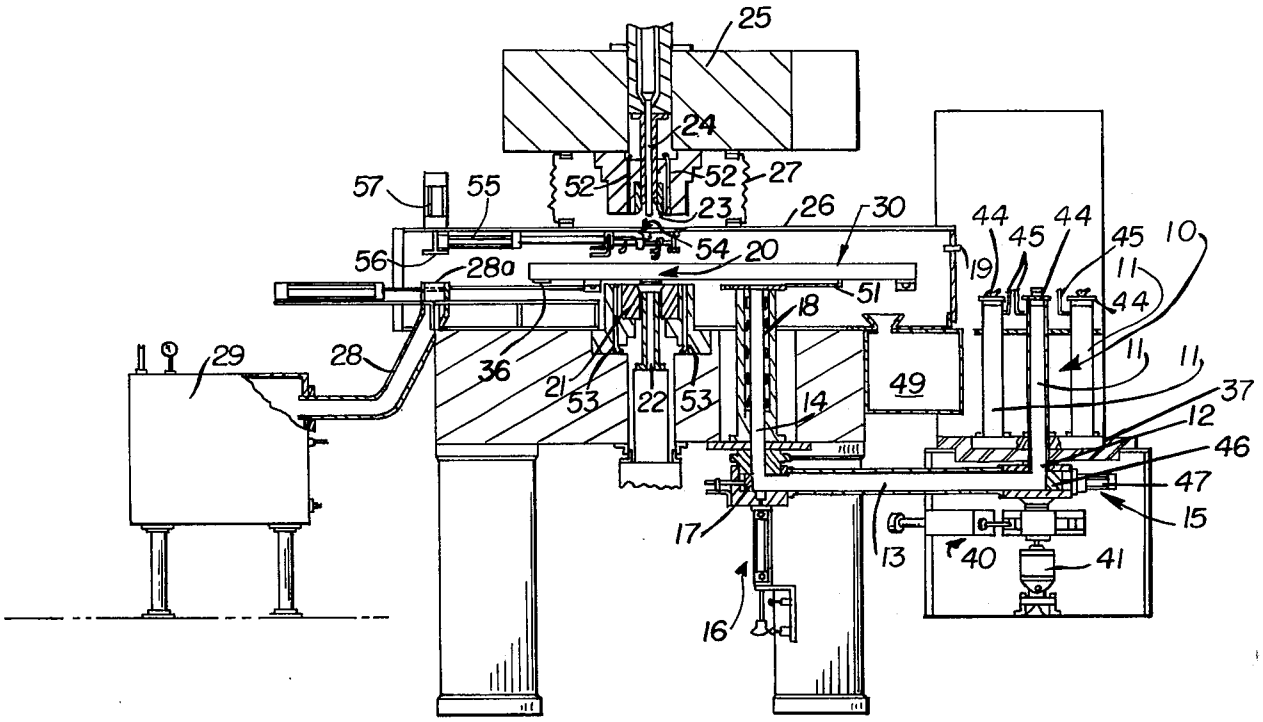
FIG. 1 is an elevational view partly in cross section of an apparatus according to the present invention.

For a general description of the apparatus reference is made to FIG. 1. The feed turret is indicated generally at 10 and it comprises in the embodiment shown four feed tubes, three of which are shown at 11. The turret is arranged for rotation about a vertical axis and is capable of a small amount of vertical movement for reasons which will be explained hereinafter. The feed tubes 11 in turn are aligned with a vertical feed tube 12 which communicates with a horizontal feed tube 13, which in turn communicates with a vertical feed tube 14. A pusher mechanism indicated generally at 15 pushes the lowermost preform of the stack in feed tube 12 into the horizontal feed tube 13 and during operation the feed tube 13 will be filled with a succession of preforms. At the left end of the horizontal feed tube 13, there is a pusher mechanism indicated generally at 16 to push the leftmost preform upwardly into the tube 14. A stop member 17, which will be described in more detail hereinafter, moves to support the stack of preforms in the vertical tube 14 while the plunger of the mechanism 16 retracts to permit movement of another preform into position.

The vertical tube 14 is provided with an induction heating coil 18 so that the preforms, as they move upwardly through the tube 14, are heated up to forging temperature or above. A suitable temperature indicator may be provided at 19 and be positioned to read the temperature of a preform emerging from the top of the tube 14.

Assuming that the preform emerging from tube 14 is at the correct temperature, it is then transported to the foring position indicated generally at 20. At the forging station there is provided a lower die 21 and a lower punch 22 and an upper die 23 and an upper punch 24. The upper platen 25 is connected to the top of the chamber 26 by means of the bellows seal 27.

At the left hand end of the apparatus is a discharge tube 28 through which the forged work pieces pass into a cooling chamber at 29. It will be understood that the tubes 11 of the turret as well as the tubes 12, 13, and 14, the interior of the chamber 26, the tube 28, and the chamber 29, all together constitute a sealed system and that this entire sealed system is subject to a non-oxidizing atmosphere.

Figure 4:
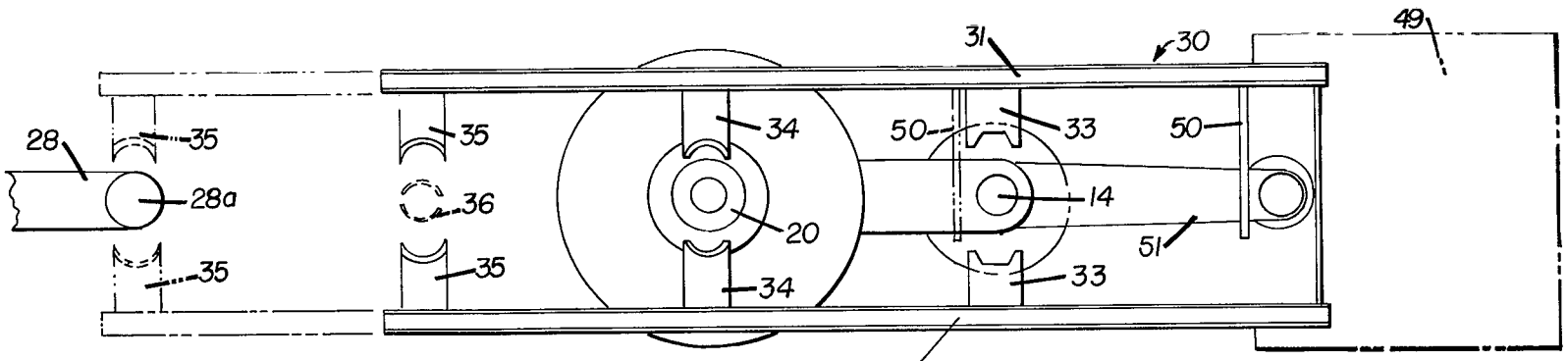
FIG. 4 is a plan view of the "Livernois" mechanism for handling the preforms.

The movement of the work piece in the chamber 26 is achieved by means of a so-called "Livernois" mechanism shown generally at 30 in FIGS. 1 and 4. This type of mechanism is well known and does not in itself constitute a part of the invention. Basically in consists of two parallel members 31 and 32 provided with opposed pairs of gripping fingers 33, 34 and 35. In the particular embodiment shown, the arrangement is such that the distance between the centerline of the tube 14 and the centerline of the forging station is equal to the distance between the pairs of fingers 33 and 34 and also between the pairs of fingers 34 and 35. The "Livernois" mechanism, as is well understood, is provided with means for causing the parallel members or finger bars 31 and 32 to move toward each other to grip elements between the said fingers and then means are provided to reciprocate the finger bars 31 and 32 by means of a hydraulic cylinder (not shown). Also it will be seen that in the particular embodiment shown, the distance between the centerline of the forging dies and the centerline of the discharge port 28*a* of tube 28 is twice the distance between the respective pairs of fingers. Thus, with the "Livernois" mechanism 30 in the position shown in FIGS. 1 and 4 the right hand pair of fingers 33 will grip the uppermost preform emerging from the vertical tube 14. The pair of fingers 34 will grip a piece which has been forged at the forging station and the left hand pair of fingers 35 will grip a forged piece which has been previously deposited half-way between the centerline of the dies and the centerline of the port 28*a.* When the "Livernoise" mechanism is then caused to move to the left a distance equal to the distance between pairs of fingers, the finger bars 31 and 32 separate, it will be seen that the fingers 33 will have moved a preform from the heating station to the forging station. The fingers 34 will have moved a forged piece from the forging station to a rest station, indicated in FIGS. 1 and 4 at 36, and the fingers 35 will have moved a previously forged piece from the rest station 36 to the discharge station 28*a.* Thus, a finished work piece passes through the tube 28 into the cooling chamber 29 and the "Livernois" mechanism with its fingers apart moves back to the position of FIGS. 1 and 4.

Figure 5:
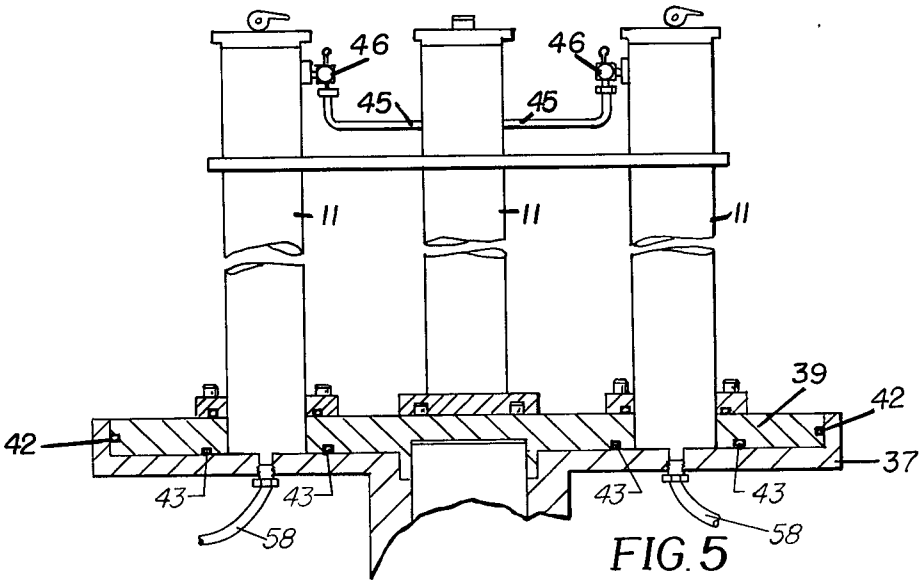
FIG. 5 is a cross sectional view of the turret structure seen at the right hand end of FIG. 1.

Referring now in more detail to FIGS. 1 and 5, there is provided a bushing 37 in the form of a circular shallow cap having a bore therethrough comprising the upper portion of tube 12. The turret proper comprises a plate 39 which is circular and fits snugly within the bushing 37. The several feed tubes are secured in holes in the plate 38 in symmetrical relationship. The plate 39 is arranged for periodic rotation by means of the mechanism indicated generally at 40 (FIG. 1) and for slight vertical movement by means of a mechanism 41 (FIG. 1). It will be noted that the plate 39 is sealed against the bushing 37 by means of an O-ring 42 and that there is an O-ring 43 surrounding each of the feed tubes 11 at the bottom of the plate 39 to seal the tubes against the plate.

As the turret intermittently rotates, the several tubes 11 are in turn brought into registry with the tube 12 so that the powder metal preforms in such tubes 11 may be dropped into tube 12 and thereafter fed by mechanism 15 into the tube 13. At each rotation of the turret through a quarter turn, the plate 39 and its associated parts are slightly lifted by the mechanism 41 and then drop back into position in order to reduce wear on the O-rings 43.

Each of the tubes 11 is provided with a sealable end cap 44 and for each tube there is a connection 45 to a source of non-oxidizing atmosphere. As best seen in FIG. 5, a small valve 45*a* is provided for each of the tubes 11.

In the operation of the apparatus, that tube 11 which has just had its contents transferred to the tube 13 through tube 12 moves on to a loading station. At this station, the sealable cap 44 is removed and a number of powder metal preforms is inserted into the tube 11. During this operation, the respective valve 45*a* is actuated to shut off the flow of non-oxidizing gas. As soon as the tube 11 has been filled, the cap 44 is replaced, the valve 45*a* is actuated and a vacuum is pulled on that tube through a port 58 in the shallow cap 37 to purge the air from it and fill it with the non-oxidizing gas. A vacuum port 58 is provided at each subsequent station prior to the unloading station to continue the purge if desired. By virtue of the structure described in connection with FIG. 5, the freshly loaded tube 11 is then maintained subject to a non-oxidizing atmosphere during the rotation of the turret until it again comes to the loading position.

The mechanism 40 and 41 will not be described in detail except to indicate that they operate together to raise the turret slightly and rotate it a quarter turn and lower it again. Mechanisms for accomplishing this are well known in the art.

The mechanism 15 comprises simply a pusher element 46 which is reciprocated by a piston in cylinder 47 under fluid pressure. It will be understood that if there is a stack of preforms in a tube 11 and the tube 12, a movement to the left of the pusher 46 pushes the lowermost preform into the tube 13 and, when the pusher returns toward the right to the position shown in FIG. 1, the entire stack of preforms drops by one unit.

Figure 2:
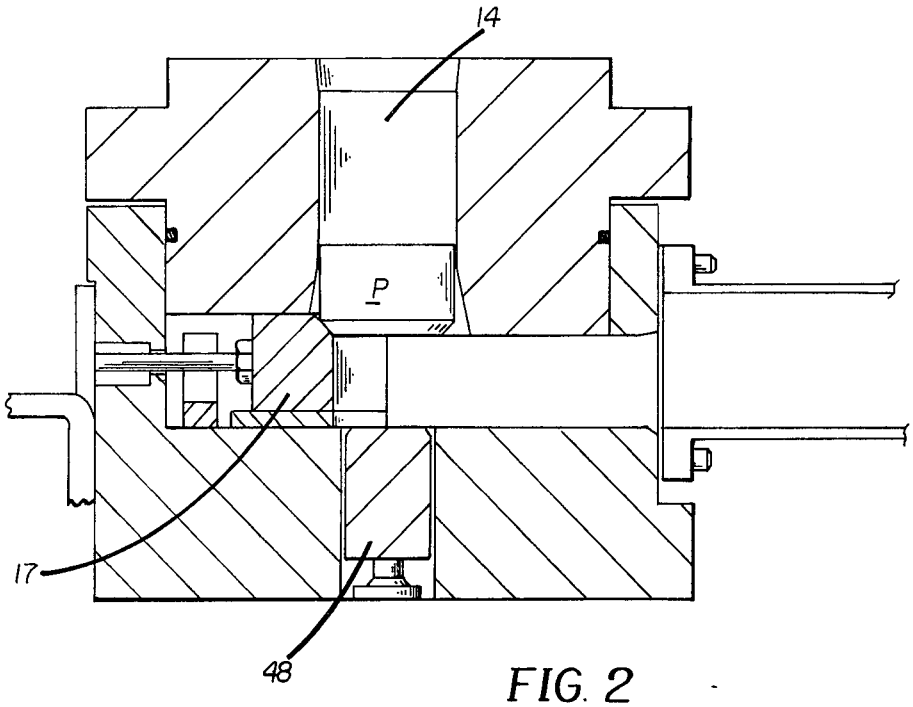
FIG. 2 is a fragmentary cross sectional view on an enlarged scale of a portion of FIG. 1.
Figure 3:
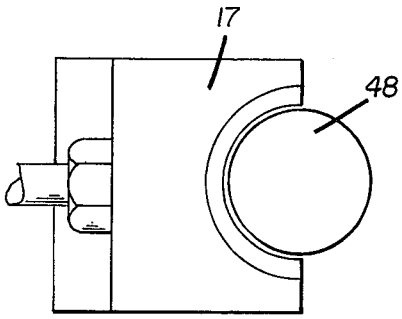
FIG. 3 is an enlarged plan view of a stop member seen in FIG. 2.

The mechanism for moving the preforms from the tube 13 into the tube 14 is shown in more detail in FIGS. 2 and 3. A small pusher 48 is actuated by means of a fluid cylinder 16 (FIG. 1) to lift up a stack of preforms into the tube 14. The stop member 17 which is shown in plan view in FIG. 3 is also reciprocated by means of a fluid cylinder and when the pusher 48 has elevated the stack in the tube 14, the stop member 17 moves to the right to the position shown in FIG. 2. Pusher 48 is then retracted to the position shown in FIG. 2 causing the lowermost preform P in tube 14 to be supported by the stop member 17 peripherally over approximately one-half of its circumference. The succession of preforms in the tube 13 can then be pushed forwardly by the pusher 46 to bring another preform into position under the preform P. The movement of the new preform into position moves the stop member 17 back out of the way.

It is important that the preforms be at a correct forging temperture for successful operation of the device. For example, with respect to a particular product currently being made, the forging temperature is about 1526° F.

The preforms at the start-up of operation will likely not be at the correct forging temperature. A number of preforms must therefore be ejected into receptacle 49 (FIG. 1), provided for this purpose, until device 19 indicates that the preforms are at proper forging temperture. To do this the "Livernois" device is indexed its maximum travel to the left from the position shown in FIG. 4 and the finger bars 31 and 32 are reciprocated toward each other. In this position, finger 50 (FIG. 4) is several inches to the left of tube 14 and its length extends more than half way between finger bars 31 and 32, as shown in dotted lines in FIG. 4. With the "Livernois" unit in this position, indexing mechanisms 47, 17 and 16 are actuated to increase the number of preforms stacked in tube 14 by one, causing one preform to extend beyond the top of tube 14. The "Livernois" unit is then moved to the right causing finger 50 to contact the topmost preform and sweep it along tray 51 (FIGS. 1 and 4) and into receptacle 49. Following this, the "Livernois" unit is again returned to its leftmost position and the cycle is repeated until device 19 indicates that the preforms are at proper forging temperature. Following this the "Livernois" mechanism is moved to the position as shown in FIG. 4, and the forging cycle is started.

The dies, of course, will vary with the object being forged. The particular die shown and the configuration of the preform shown in FIG. 2 are for forging of small bevel gears. The sequence of operation of the dies need not be described in detail since it is well known, but basically with the dies open and a preform is moved into place, the upper die closes onto the lower die and the upper punch is moved down into position. The upper punch then goes through its forging action and thereafter the upper punch is withdrawn and the upper die is withdrawn and then the lower punch ejects the forged work piece from the lower die. In order to avoid severe thermal shock to the dies and possible heat checking (cracking), both upper and lower dies are provided with heating elements indicated respectively, at 52 and 53 (FIG. 1), which maintain the dies at a temperature between about 300° F and about 575° F. During the forging operation, of course, the dies get much hotter and they are cooled by means of water spray and then lubricated with graphite before a subsequent forging operation. The cooling and lubricating nozzles are indicated generally at 54 and they are moved into position when the dies are open, as seen in FIG. 1, by means of a fluid cylinder 55 and then retracted prior to the next forging operation. It is also within the scope of the invention to provide the preforms with a coating of graphite lubricant of types well known in the art. Such a coating is applied prior to the heating step.

In order to remove a finished work piece from the cooling chamber 29 without subjecting the sealed system to he ambient atmosphere, a stopper member is provided at 56 which is actuated by a fluid cylinder 57. The stopper 56 is arranged to seal over the entrance to the discharge port 28*a* so as to cut off the cooling chamber 29 from the rest of the sealed system. One wall of the chamber 29 is provided with a gasketed quick release opening structure whereby the finished pieces may be removed from the chamber. The closure is then replaced and the chamber 29 purged, whereupon the stopper 56 is retracted to connect the chamber back into the sealed system. In actual practice, it may be desirable to cool the forged work pieces down to about 300° F in the chamber 29 before removing them to the ambient atmosphere.

It will be understood by one skilled in the art that the present invention is not limited to the use of the cooling chamber 29. Other means could be used, which would best suit the needs of the particular manufacturer. For example, it would be within the scope of the invention to provide two chambers similar to chamber 29. Under such circumstances, each chamber could be shiftable between a position wherein it is connected to discharge tube 28 and a position wherein it is not so connected. Thus, while one chamber is being filled with forged parts, the other chamber could be emptied. Thus, the cycle would be interrupted only for a few seconds during the shift of one chamber for the other, rather than for a number of minutes required when a single chamber is being emptied.

It would further be possible to provide a double acting cylinder chamber with high gas flow therethrough, to eject each part individually from the system.

It would also be possible to provide an oil tank into which the end of discharge tube 28 would extend. In this instance, the fluid would serve as an interface between the atmosphere and the system's atmosphere.

As yet another alternative, it would be within the scope of the invention to substitute a conveyor means at the end of discharge tube 28. The conveyor could be enclosed in a protective atmosphere. In this manner, the forged parts could be conveyed directly to the next step in the manufacturer's process, as for example to a furnace for a further heat treatment, or the like.

Figure 6:
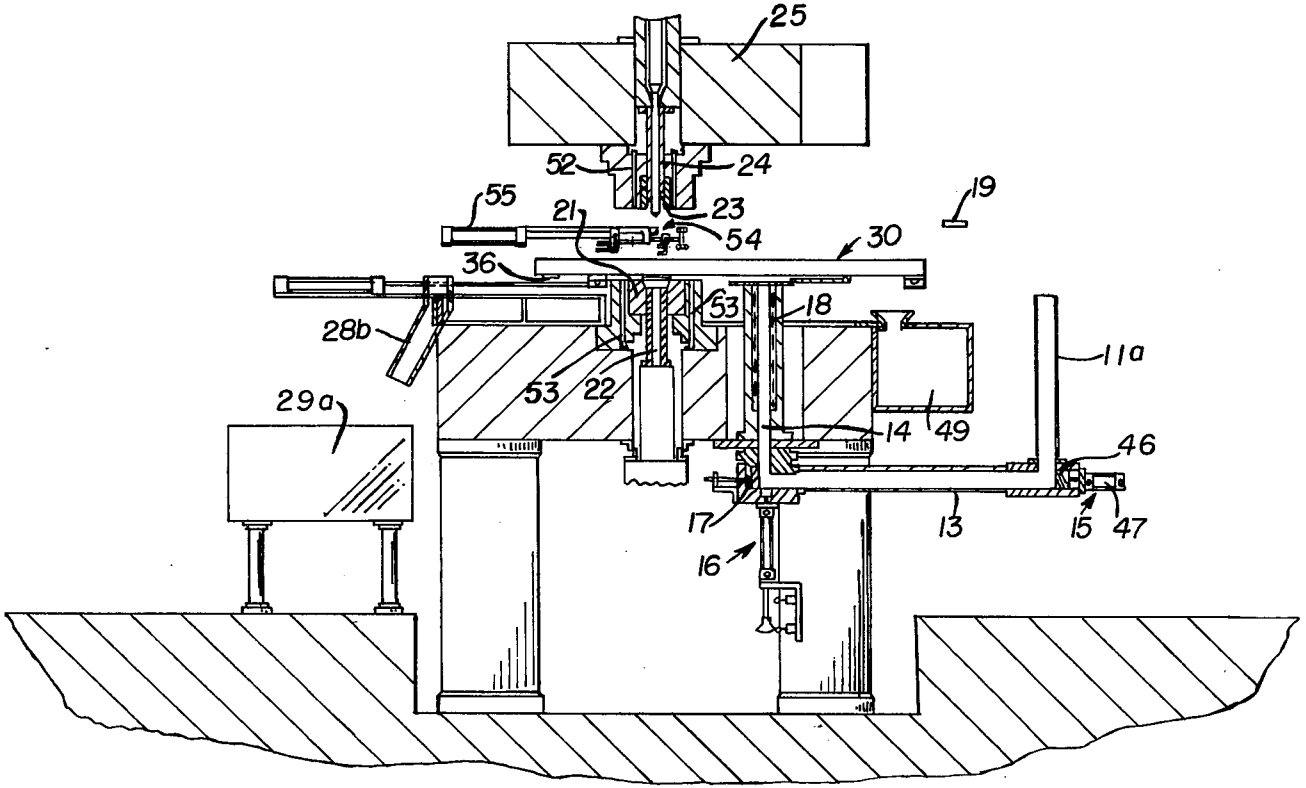
FIGS. 6, 7 and 8 are elevational views, partly in cross section, illustrating additional embodiments of the present invention.

A second embodiment of the present invention is illustrated in FIG. 6. This embodiment differs from that of FIG. 1 primarily in that it is for use with powder metal preforms where no protective atmosphere is required. As a consequence, like parts have been given like index numerals.

As indicated above, ordinarly forging processes are fundamentally different from a powder metal forging process and rely on less stringent time and temperature relationships. This is true because ordinary forging preforms are not subject to internal oxidation and external oxidation can be accommodated since the preforms contain an excess of metal. The time and temperature relationships are dependent upon such factors as the nature of the final product, the type of powder metal preform used and the type of powder metal from which the preform is made. Powder metals for preforms are constantly being changed and improved. Prior art attempts to achieve the proper time and temperature relationships generally resulted in slow processes requiring the heating and forging of the preforms on a one-at-a-time, individual basis. It was therefore believed that the hot forging of finished articles from powder metal preforms did not lend itself to a high-rate, production process.

The high-rate process and apparatus of the present invention are such that with many types of powder metal preforms the time and temperature relationships are within the permissible range for the particular preform used and product produced to enable the process and apparatus to be used without the use of a special atmosphere.

Tests have shown, for example, that when dealing with a ferrous powder metal preform, for a good end product of high impact strength the end product should have a total oxygen content of no more than from about 500 to about 1000 ppm and preferably about 500 to about 650 ppm. If the only criterion is tensile strength, without impact properties, the upper limit of the total oxygen content for the end product is about 2000 ppm.

For ferrous powder metal preforms the forging step should be accomplished at a temperature range for the preform of from about 1400° F to about 1875° F to assure dimensional control and good surface characteristics of the forged part. For a preform which has been coated with a graphic lubricant and is to be forged at a temperature within this range, to assure a total oxygen content of the finished part within the limits stated above, the time of exposure of the preform to the atmosphere from the heating step to the forging step should not exceed about 1 minute if tensile strength is the primary property sought in the end product and should not exceed about 36 seconds if the end product is to have good impact strength. In the absence of a graphite coating these times should be reduced to about 30 seconds and 16 seconds, respectively. In all cases the higher within the temperature range the forgoing is performed, the lower within the time ranges the transfer should take place. While not required, it is desirable that the heating step be performed under atmosphere protection. The process and apparatus of the present invention is fully capable of functioning within these parameters.

In the embodiment of FIG. 6, any suitable means may be used to convey preforms to the tube 14 comprising a part of the induction heating unit. For purposes of an exemplary showing, a vertical receiving tube is shown at 11a. The tube 11a connects directly to horizontal feed tube 13. When tube 11a is filled with a stack of preforms, the preforms, will be advanced through feed tube 13 by pusher element 46, in the manner as described above.

As in the case of the structure of FIG. 1, a suitable temperature indicator 19 will be used to sense the temperature of the preforms emerging from the induction heating unit. The temperature indicator may be mounted by any suitable means (not shown).

The remainder of the structure of FIG. 6 is substantially identical to that of FIG. 1 with the exception that no provision need be made to maintain the preforms in a protective atmosphere as they pass through the apparatus assembly. For example, in the embodiment of FIG. 6, it is not necessary to provide means to close the entrance end 28a of the discharge tube.

For purposes of an exemplary showing, discharge tube 28b is illustrated as emptying into a simple, open cooling chamber or bin 29a. It will be udnerstood that, as in the case of the embodiment of FIG. 1, other means may be provided to receive the formed parts as they exit discharge tube 28b. For example, an oil quench tank could be used, as could a conveyor means or the like.

With the exception of the fact that a protective atmosphere is not used, the operation of the embodiment of FIG. 6 is, in other respects, identical to that of FIG. 1.

Figure 7:
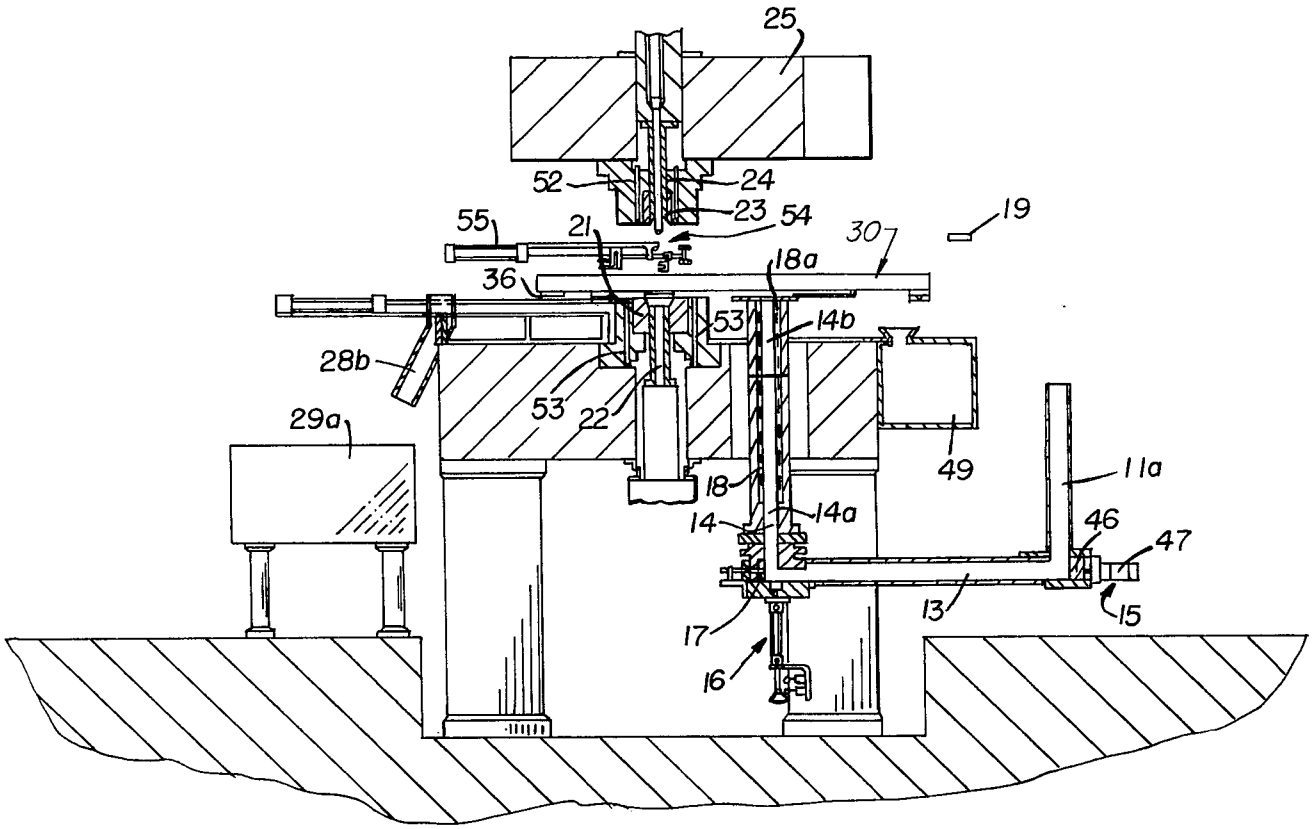

FIG. 7 illustrates an embodiment similar to FIG. 6, like parts again having been given like index numerals. The structure of FIG. 7 differs from that of FIG. 6 only in that the vertical tube 14 has been lengthened. The lower portion 14a of the tube 14 is again surrounded by an induction heating coil 18. The upper portion 14b of the tube 14 is intended to serve as a cooling passage for the preforms. The upper portion 14b may simply be an extension of tube 14 without an induction heating coil thereabout. Alternatively it may be surrounded by a cooling coil, containing a suitable coolant. Such a cooling coil is indicated at 18a.

The purpose of the above described structure is twofold. First of all, it enables the attainment of a controlled temperature distribution throughout the body of each preform. As is well known, induction heating is characterized by the fact that the majority of heat is generted in an element in a region near its surfaces. The heating of the interior portion of the element is mainly by conduction. As a consequence, in order to attain a desired temperature level at the interior of the element, it is necessary to heat the surfaces of the element to a higher temperature, or provide for a relatively long heating time.

The elongated tube 14 of FIG. 7, having a portion 14a comprising an induction heater and a portion 14b comprising a cooling passage, enables the operator to heat the preforms to a temperature above the optimum forging temperature during their passage through tube portion 14a. Thereafter, as the preforms pass through tube portion 14b, they are permitted to cool to the optimum forging temperature. This, therefore, permits careful and accurate temperature control with respect to the preforms.

In addition, the ability to heat preforms above the optimum forging temperature and thereafter to cool the preforms to the optimum forging temperature, enables the attainment of many desired metallurgical properties in the final product. The embodiment of FIG. 7 enables this to be done in an automatic process.

Figure 8:
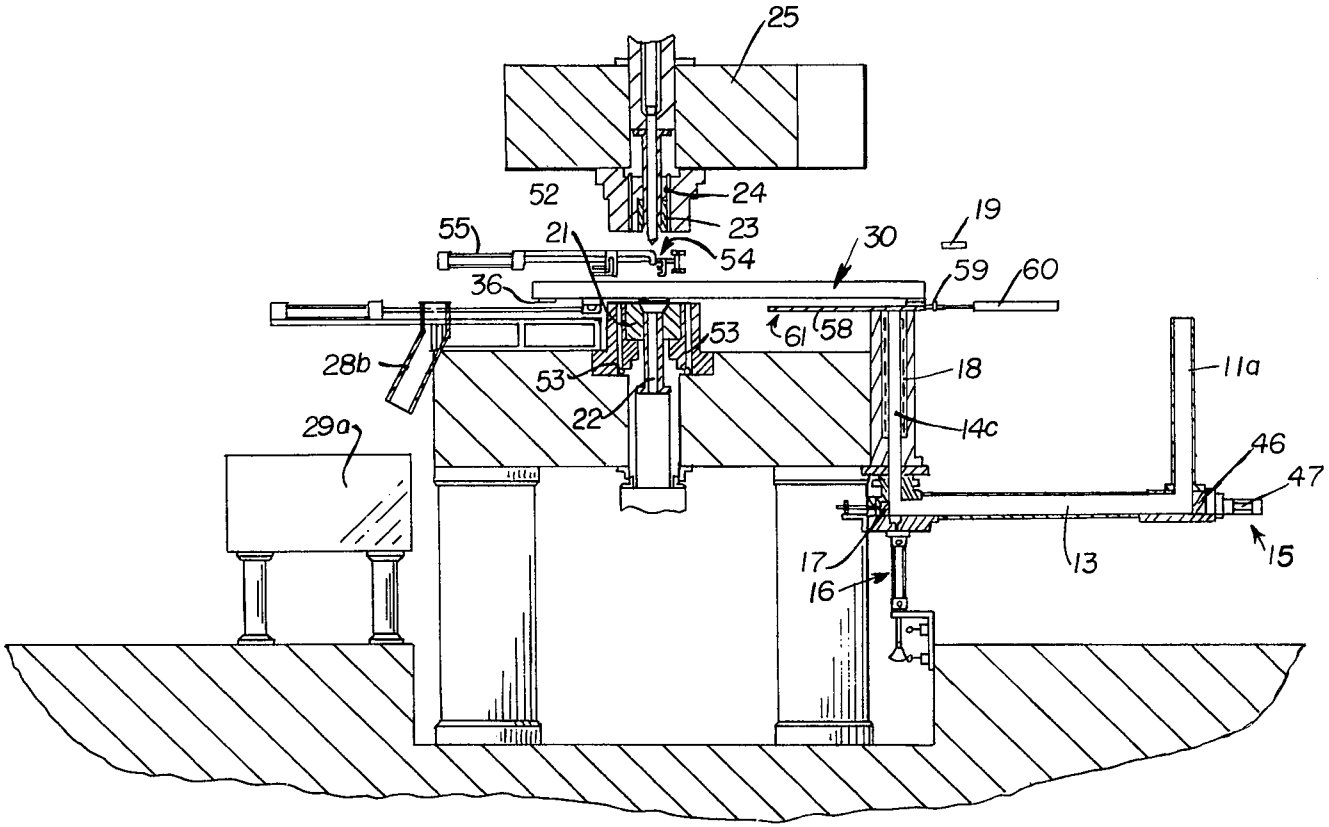

FIG. 8 illustrates yet another embodiment of the present invention similar to that of FIG. 6, but with the induction heating unit mounted exteriorly of the press table. Again, like parts have been given like index numerals, with the exeption that the induction heating tube has been designated 14c.

In this embodiment, a horizontally oriented tray-like element 58 extends from the upper end of the vertical tube 14c toward the forging station. The tray may be supported by any suitable means. As the preforms move upwardly through the vertical tube 14c, in the same manner described with respect to the tube 14 in FIG. 6, the uppermost preform will be caused to move laterally onto the tray-like element 58 by the action of a pusher element 59 which is reciprocated by a piston in a cylinder 60 under fluid pressure.

As each preform exits vertical tube 14c and is caused to move laterally by pusher element 59, preforms on the tray-like element will be moved therealong to a position generally indicated at 61 wherein they may be picked up by the "Livernois" mechanism. Thereafter, the operation of the structure of FIG. 8 is identical to that of FIG. 6.

It will be understood by one skilled in the art that the embodiment of FIG. 8 has the same advantages described with respect to the embodiment of FIG. 7. Thus, it is possible to heat the preforms in the induction heater tube 14c to a temperature higher than the optimum forging temperature. Thereafter, the preforms may cool to the optimum forging temperature during their traverse of the tray-like element 58.

In the embodiment of FIG. 8 it will be noted that a temperature indicating device 19 is again provided to sense the temperature of the preforms as they exit vertical tube 14c. Means (not shown) may be provided to eject from the tray-like element 58 any preform which has not attained the desired temperature. Such means may take any suitable form including a pusher device, capable of reciprocating in a direction transverse to the long axis of the tray-like element 58. Such a pusher device may be actuated by a signal from the temperature sensing device 19.

It will be understood by one skilled in the art that the apparatus described above can be installed on already existing presses to convert them to the automatic system of the present invention.

Figure 9:
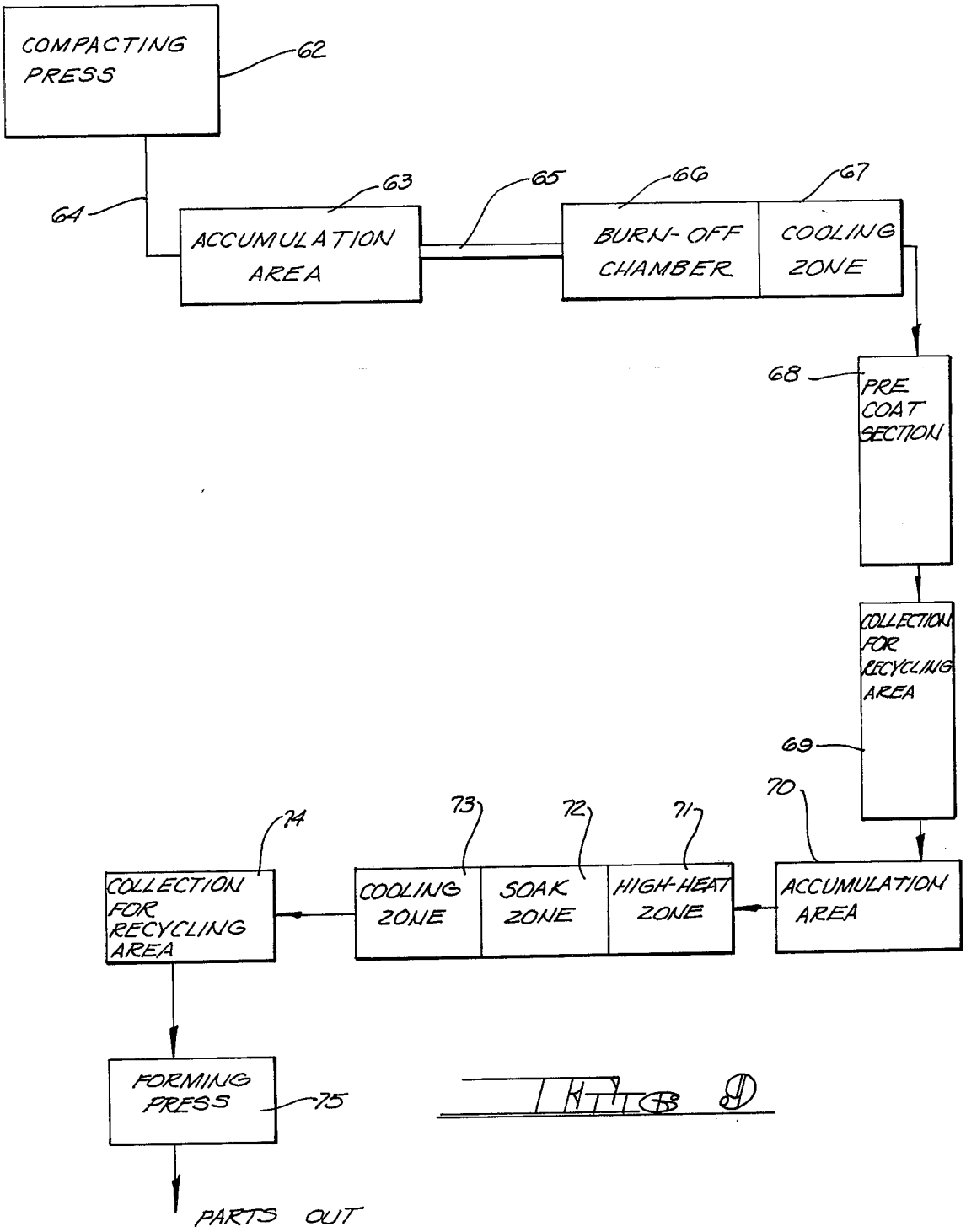
FIG. 9 is a diagrammatic representation of the system of the present invention including the sintering of the preforms prior to hot forging.

FIG. 9 diagrammatically illustrates a continuous, fully automated system wherein the heating step of the present invention has been combined with a sintering step for the preforms. The system of FIG. 9 requires the attention of only one operator and is capable of functioning under production conditions with practical production reliability. In FIG. 9, a compacting press is shown at 62. The compacting press may be of any suitable, well known type for the production of powder metal preforms of carefully controlled weight. The press 62 may have, in association therewith, a separating mechanism (not shown) to reject preforms of improper weight. From the press 62 preforms of good quality and characteristics are transferred to an accumulation area 63 by any appropriate form of conveyor means 64. The purpose of the accumulation area is to take up any backlog of preforms and to accommodate for any differences in production rates of the compacting press and the forging press, including such events as a momentary delay not requiring shutdown of the entire system. In this way, the accumulation area 63 will assure a constant production rate.

From the accumulation area 63 the preforms will be transferred by a belt conveyor 65 (or other type of conveying means) to a burn-off furnace or chamber 66. The burn-off chamber may take the form of an electric furnace, a gas furnace or an induction heating means and will have a protective atmosphere such as a nitrogen atmosphere to prevent oxidation of the preforms. The purpose of the burn-off chamber is to remove from the surfaces of the preforms die wall lubricants picked up during the compaction step. Preferably, the preforms will be rapidly heated in the burn-off chamber to a temperature of from 700° F. to 900° F. While the reaction of expelling the lubricants is volatile in nature and begins at approximately 450° F, by going to the higher temperatures stated above, this burn-off time is reduced and the reaction will continue as the preform begins to cool. After burn-off, the preform will be caused to enter a cooling zone 67 where forced cooling (by any suitable well known means) will lower its temperature to approximately 300° F.

It will, of course, be understood that it will be unnecessary to utilize a burn-off furnace or chamber 66 if the dies are not lubricated with graphite or some other appropriate lubricant before a subsequent forging operation. However, some suitable furnace (induction or forced convection, etc.) will still be required to heat the preforms for the purpose of coating them.

From the burn-off chamber 66 and cooling zone 67 the preforms will pass through a precoat section 68 wherein they will be given a coating of graphite lubricant of any appropriate and well known type. The graphite lubricant coating serves two purposes. First of all, it tends to retard oxidation of the preforms. Secondly, it assists during the forging step and may, in fact serve as the sole lubricant source for the forging dies.

For this reason, the obtaining of a tenacious graphite lubricant coating is very important. A clean surface on the preform and a proper temperature of the preform is required and these will be obtained in the burn-off chamber 66 and its cooling zone 67.

By precoating with the graphite lubricant when the preforms are at approximately 300° F, the water in the graphite spray will be expelled. This is extremely important in the high heat section, next to be described, where the dewpoint of the gas is critical. Means may also be provided to clean the belt conveyor (or other suitable conveying means) within the precoat section to prevent a buildup of the graphite coating due to overspray. Means should be provided at the precoat section 68 to prevent contamination of the surrounding air by the lubricant spray.

At the end of the precoat section 68, there will be a collection for recycling area 69 wherein preforms which must be rejected for reasons such as improper precoating of start-up or shutdown sequences are collected. Such preforms are metallurgically sound and can be recycled through the system. From the recycling area 69, the preforms will pass to a second accumulation area 70. Again, the purpose of accumulation area 70 is to assure a constant production rate.

From accumulation area 70, the preforms will next be subjected to a heating system wherein, as mentioned above, the steps of sintering and preheating to forging temperature are combined. To this end, from the accumulation area 70 the preforms are caused to pass to a high heat zone 71 comprising, for example, an induction heating unit wherein the preforms will be heated to from about 2200° F to about 2250° F. The use of induction heating means enables rapid heating with a minimal length of heating section.

From the high-heat zone 71 the preforms will be caused to pass through a soak zone 72. The high-heat zone and soak zone will preferably be in the same chamber and be provided with a protective atmosphere. The soak zone 72 may, for example, constitute an electric furnace wherein the preforms are maintained at a temperature of from about 2000° F to about 2250° F. The preforms pass through the high-heat zone and soak zone on a belt conveyor, a tray conveyor, or other suitable conveying means, assuring separation of the preforms to avoid sticking together.

Conventional sintering atmospheres (25% nitrogen, 75% hydrogen) are explosive. The high-heat zone 71 and soak zone 72 of the present invention may use a non-explosive atmosphere of 95% nitrogen and 5% hydrogen. Approximately the same oxide reduction potential as with conventional sintering atmospheres may be maintained by drying the gas mixture to minimize its water vapor content.

From the soak zone 72 the preforms will be caused to pass through a cooling zone 73 such as a cold wall environment or chamber, wherein heat loss will be accomplished by radiation. The cooling zone may also be a part of the same chamber. The preforms will be cooled to a temperature slightly above the forging temperature to compensate for transfer time from the cooling zone to the forging station. The cooling zone 73 may be provided with the same protective atmosphere as the soak zone 72 and high-heat zone 71.

At the end of the cooling zone, there may also be provided a second collection for recycling area 74 serving substantially the same purpose as the collection for recycling area 69 and provided with atmosphere protection to prevent oxidation of the preforms.

From the area 74 the preforms will pass to a forming press 75 wherein they will be forged at a temperature of from about 1700° F to about 1875° F. For most purposes a conventional press transfer mechanism may be used to shift the preforms from area 74 to the press and no atmosphere protection need be provided since this transfer can be accomplished in five seconds or less. Should, for one reason or another, atmosphere protection be desired, it may be provided for the transfer mechanism in any suitable way.

For most types of formed parts, again no atmosphere protection will generally be required. However, if desired, a cooling zone or transfer mechanism with atmosphere protection may be provided following the forming press 75, in any of the ways described above.

For the finished parts produced by the method and apparatus of FIG. 9, the same total oxygen content limitations stated above hold true, depending upon whether tensile strength or high impact strength is desired for the final product.

Modifications may be made in the invention without departing from the spirit of it. For example, it will be understood that the embodiments of FIGS. 7 and 8 may be provided with means such as those described with respect to FIG. 1 whereby the preforms may be maintained in a protective atmosphere throughout their travel through the apparatus assembly.

While, for purposes of an exemplary showing, mention has been made of the manufacture of a specific bevel gear which, in finished form, has a density on the order of 7.70 to 7.85 g/cm$^3$, it will be understood that the product produced by the method and apparatus of the present invention does not constitute a limitation thereof. The nature of the punch and die elements, the nature and configuration of the preforms and the like, are all variable depending upon the nature of the finished article to be produced. Therefore, no limitation not specifically set forth in the claims is intended or should be implied.

The embodiments of the invention in which an exclusive property or privilege is claimed are defined as follows:

1. A fully automated, continuous process of producing finished parts from compacted powder metal preforms at a high production rate which comprises the steps of introducing the preforms into a vertically oriented tube-like feeding station, depositing the preforms from said feeding station to a conveying means one-by-one by gravity, conveying said preforms to a vertically oriented induction heating station, advancing said preforms through said heating station and heating them to at least a forging temperature, transferring a heated preform from the upper end of said heating station to a forging station and simultaneously removing a finished part from said forging station, and forging each of said preforms at said forging station.

2. The process claimed in claim 1 including the step of controlling the oxidation of said preforms to provide finished parts having a total oxygen content of not more than from about 500 to about 1000 p.p.m.

3. The process claimed in claim 1 including the steps of forging said preforms at a temperature of from about 1400° F to about 1875° F and transferring each preform from said heating station to said forging station in not more than about 30 seconds.

4. The process claimed in claim 1 including the steps of coating said preforms with a graphite lubricant prior to advancing said preforms through said heating station, forging said preforms at a temperature of from about 1400° F to about 1875° F and transferring each preform from said heating station to said forging station in not more than about 1 minute.

5. The process claimed in claim 1 wherein said preforms are heated above forging temperature and thereafter cooled to forging temperature prior to said forging step.

6. The process claimed in claim 1 wherein said forging step is accomplished by dies, and including the steps of maintaining said dies at an elevated temperature, and, after each forging operation, applying to said dies a coolant, and thereafter lubricating said dies.

7. The process claimed in claim 1 including the step of maintaining said preforms in a non-oxidizing atmosphere from said feeding station through said forging station.

8. The process claimed in claim 1 including the step of maintaining a non-oxidizing atmosphere in said heating station.

9. The process claimed in claim 2 including the steps of forging said preforms at a temperature of from about 1400° F to about 1875° F and transferring each preform from said heating station to said forging station in not more than about 16 seconds.

10. The process claimed in claim 2 including the steps of coating said preforms with a graphite lubricant prior to advancing said preforms through said heating station, forging said preforms at a temperature of from about 1400° F to about 1875° F and transferring each preform from said heating station to said forging station in not more than about 36 seconds.

11. The process claimed in claim 7 including the steps of transferring said finished parts from said forging station to a cooling station and maintaning a non-oxidizing atmosphere at said cooling station.

12. The process claimed in claim 5 including the steps of providing a tray-like idle station at the upper end of said induction heating means, depositing each of said preforms from said induction heating means onto said tray-like idle station, causing each of said preforms to cool to optimum forging temperature on said tray-like idle station and transferring each of said preforms from said idle station to said forging station.

13. A fully automated, continuous process of producing finished parts from compacted powder metal preforms at a high production rate which comprises the steps of forming powder metal preforms in a press, conveying said preforms to a heating chamber to clean said preforms, providing a non-oxidizing atmosphere in said heating chamber and through-heating said preforms to a temperature of up to a maximum of about 900° F., transferring said preforms to a cooling zone and cooling said preforms to about 300° F., transferring said preforms to a coating station, coating said preforms with a graphite lubricant, transferring said preforms to an induction heating station, at said induction heating station heating said preforms rapidly to a temperature of from about 2050° F. to about 2250° F., providing a soaking zone, transferring said preforms to said soaking zone, soaking said preforms at a temperature of from about 2000° F. to about 2250° F., providing a cooling zone, transferring said preforms to said cooling zone, providing a forging station, transferring said preforms from said cooling zone to said forging station, cooling said preforms in said cooling zone to a temperature such that they will be at the desired forging temperature when they reach said forging station, forging said preforms and maintaining said preforms in a non-oxidizing, slightly reducing atmosphere through said heating, soak and cooling steps.

14. The process claimed in claim 13 including the step of transferring said preforms from said cooling zone to said forging station in not more than about 5 seconds.

15. The process claimed in claim 13 including the step of soaking said preforms for at least about 3 minutes.

16. The process claimed in claim 13 wherein said non-oxidizing slightly reducing atmosphere comprises 95% nitrogen and 5% hydrogen.

* * * * *